US009165539B2

(12) United States Patent
Ostosh

(10) Patent No.: US 9,165,539 B2
(45) Date of Patent: Oct. 20, 2015

(54) MULTIPLE CONTIGUOUS CLOSED-CHAMBERED MONOLITHIC STRUCTURE GUITAR BODY

(71) Applicant: Brian Walter Ostosh, Spring Valley, CA (US)

(72) Inventor: Brian Walter Ostosh, Spring Valley, CA (US)

(73) Assignee: Brian Walter Ostosh, Spring Valley, CA (US)

( * ) Notice: Subject to any disclaimer, the term of this patent is extended or adjusted under 35 U.S.C. 154(b) by 21 days.

(21) Appl. No.: 13/899,191

(22) Filed: May 21, 2013

(65) Prior Publication Data

US 2014/0345441 A1 Nov. 27, 2014

(51) Int. Cl.

| | |
|---|---|
| ***G10D 1/08*** | (2006.01) |
| ***G10D 3/00*** | (2006.01) |
| ***G10D 3/02*** | (2006.01) |

(52) U.S. Cl.

CPC ..... *G10D 1/085* (2013.01); *G10D 3/02* (2013.01); *Y10T 29/49574* (2015.01)

(58) Field of Classification Search

CPC ..... G10D 1/085; G10D 1/005; G10D 1/00; G10H 3/18; G10H 1/32; G10H 2220/471; G10H 2250/451; G01H 9/004

See application file for complete search history.

(56) References Cited

U.S. PATENT DOCUMENTS

| | | | | |
|---|---|---|---|---|
| 4,320,685 | A | 3/1982 | Pytlewski | |
| 4,364,990 | A | 12/1982 | Haines | |
| 5,895,872 | A | 4/1999 | Chase | |
| 5,905,219 | A | 5/1999 | Westheimer | |
| 6,233,825 | B1 * | 5/2001 | DeGroot | 29/896.22 |
| 6,973,815 | B2 | 12/2005 | Bryans et al. | |
| 7,507,885 | B2 | 3/2009 | Coke | |
| 7,610,669 | B2 | 11/2009 | Keidel et al. | |
| 2005/0284281 | A1 * | 12/2005 | Suyama | 84/294 |
| 2008/0105101 | A1 * | 5/2008 | Eldring | 84/291 |
| 2008/0202310 | A1 * | 8/2008 | Coke | 84/291 |
| 2010/0031807 | A1 * | 2/2010 | Fiocco et al. | 84/743 |
| 2010/0043620 | A1 * | 2/2010 | Stagg | 84/291 |
| 2010/0101396 | A1 * | 4/2010 | Ayers | 84/294 |
| 2014/0311315 | A1 * | 10/2014 | Isaac | 84/267 |

* cited by examiner

*Primary Examiner* — Marlon Fletcher

(57) ABSTRACT

A chambered electric guitar body according to an illustrative embodiment of the present invention includes at least five contiguous closed chambers enclosed in the assembled monolithic top and bottom parts comprised of a generally solid material such as a metal. The autonomous dimensions of the chambers, cubic volumes, and thickness as well as the density of the material, allow customization of shape and guitar performance. This is accomplished by using the method provided to produce the monolithic structures using digital technology, CAD and CNC machining to achieve desired specifications.

12 Claims, 4 Drawing Sheets

MULTIPLE CONTIGUOUS CLOSED-CHAMBERED MONOLITHIC STRUCTURE GUITAR BODY

BACKGROUND OF THE INVENTION

1. Field of the Invention

The present invention relates generally to stringed musical instruments. The present invention relates more particularly to an electric guitar having a solid body based on monolithic construction that is configured so as to endow the guitar with custom performance characteristics achieved by precision manufacturing to desired specifications.

2. Brief Description of the Prior Art

This invention relates to stringed musical instruments, such as guitars, and to methods for making such stringed instruments. Stringed instruments traditionally have been constructed of wood, but also have been fabricated from other materials such as plastics, molded composite materials, and combinations of such materials. In many conventional stringed instruments, the various components are constructed separately, and then joined to form a finished instrument. Because the structural integrity of a stringed instrument affects the tonal quality and sound output of the instrument, stringed instruments made from separately joined parts experience some loss in sound quality. A musical instrument is known by its tone; in fact, tone is everything. There are numerous guitar designs, each producing a slightly different tone. Guitars vary widely not only to accommodate the various types of sound qualities desired, but also to display aesthetic qualities that reflect the user's particular style or personality. Generally there are two basic types of guitar, a hollow-bodied, thin shell, resonant guitar, such as the classic Spanish guitar, and a solid-bodied guitar, such as an electric guitar. The hollow-bodied guitar depends largely for its tone and volume on the resonance within and of the hollow body produced by the vibrating strings. The electric guitar, on the other hand, depends largely for its tone and volume upon the interaction of the vibrating strings with the magnetic field produced by a pickup positioned under the strings. Generally the hollow-bodied guitar produces a softer, mellower tone, whereas the solid body electric guitar produces a crisper, brighter tone, one of longer duration.

Over the centuries stringed musical instruments have experimented with the shape, size, and materials of construction for the main body. This has led to the familiar sounds produced by violins, guitars, cellos and basses, the sound of each being determined by the materials and design characteristics.

Wood, an organic material, has been the material of choice to produce these instruments. The selections of wood cuts (encompassing all varieties of woods), have been used to obtain the variations of tone and pitch within each class of instrument. The manufacturers of these instruments are continually striving to produce the sound desired by the player and further attempting to replicate the desired instruments' characteristics during manufacture of same.

Wood, being subject to vagaries of nature, has many distinct disadvantages which result in defects and undesirable tonal variations. These variations result from changes in the wood due to environmental growing conditions, the most prominent being temperature and humidity. These parameters can result in the swelling or shrinking of the wood resulting in unwanted tonal variations.

Lot to lot fluctuations in wood characteristics can also affect the final instrument body. These fluctuations include differing grain patterns and wood densities between trees.

Differing techniques in cutting and drying procedures between mills also contribute to lot differences.

These disadvantages have led to the development of alternative materials of construction for stringed instrument bodies. These include U.S. Pat. No. 4,364,990, disclosing an invention for a graphite fiber/epoxy resin body and U.S. Pat. No. 5,905,219, describing a stringed musical instrument body constructed from polyurethane. Other constructions have also made use of metal in all metal or composite designs using a hybrid of metal and other materials such as wood. These inventions attempt to resolve several of the problems associated with wood, but produce a sound unique to their construction which may or may not be desirable to the trained observer.

Also there have been many structural designs which attempt to reduce weight and retain the rigidity of a solid body. However, these designs also introduce new drawbacks such as panel vibrations or interference by feedback sound effects. These panel vibrations or lack of the vibrations contribute to the tonality of the various instrument bodies. For example, U.S. Pat. No. 4,731,238 describes a semi-hollow guitar apparatus.

Although innovative, none of the above mentioned efforts to develop an alternative construction material for stringed instruments offer the sound and adjustability of the present invention. A dual, top and bottom, monolithic structured, chambered metal body guitar construction eliminates many of the problems associated with variation problems in wood and shortcomings of wood itself since metal stock is produced following strict quality control procedures as in the aircraft manufacturing industry.

The method of monolithic structures has been used in the aircraft industry since the 1960's with the advent of CNC machining. This method enables complex structures, with a high strength-to-weight ratio, to maintain a rigid structure. This is usually unattainable by conventional wood and/or metal built-up design type constructions. This method is outlined in U.S. Pat. No. 6,973,815 B2, describing monolithic parts and U.S. Pat. No. 7,610,669, describing integrated monolithic aluminum structure and aluminum product machined from that structure.

The production method of the present invention allows for exact reproduction of the instrument body via digital means, CAD and CNC machining. This ensures replication of the tonal qualities of the instrument body from instrument to instrument, overcoming the variations of wood and/or other composite materials.

The historical disadvantage to an all-metal guitar body is the weight of the metal. Excessive weight results in an undesirable product. This drawback has also been overcome with the present invention by means of the internal chambering methods.

Another pervasive disadvantage to an all-metal guitar body is the thin panel vibrations and resonances. These are suppressed by the addition of damping material inside the closed chambers.

These disadvantages have also been overcome with the present invention.

SUMMARY OF THE INVENTION

The present invention specifically addresses and alleviates the above-mentioned deficiencies associated with traditional solid body guitars. More particularly, the present invention comprises a guitar body formed of a generally solid material, such as a metal with a high strength to weight ratio. The generally solid material allows a monolithic construction by precision machining of top and bottom parts of a solid guitar body, to achieve desired specifications of design and tonality. Precision machining of the monolithic guitar body further allows substantial reduction in guitar body weight by creation of enclosed chambers, without compromising the tensile strength and rigidity of the guitar body. In this manner, a solid body guitar is provided which has a unique monolithic construction that can be customized to desired specifications of design and tone, and lends itself to high volume precision manufacturing, such as investment cast, for production, including the ability of having decorative metal finishes applied.

Therefore, it is among the primary objects of the present invention to provide a novel stringed instrument having improved musical characteristics in terms of loudness, pitch and quality due to the unitary monolithic body design as well as the density of molecular composition of the material used and resultant particle movement produced by induced vibrations from the strings of the instrument.

Another object of the present invention is to provide a novel stringed instrument such as a guitar having its body composed of a high strength-to-weight ratio material such as metal and, more particularly a light weight metal such as aluminum or magnesium, which permits the fabrication of a light weight instrument of lesser or greater size and dimension than can ordinarily be achieved with instruments constructed from wood or plastic and which provides customized sound quality.

Yet another object of the present invention is to provide a novel guitar having a customized monolithic body and composed of light weight metal that permits accurate manufacturing within specified design and sound characteristics.

Still a further object of the present invention is to provide a novel guitar composed of a high strength-to-weight ratio metal such as aluminum or magnesium that provides high density molecular arrangement whereby total weight to volume ratio is favorable to the design and function.

Alternative exemplary manufacturing processes in accordance with this invention include injection-molding, compression-molding, resin transfer molding, vacuum-forming and other similar processes.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

DETAILED DESCRIPTION OF THE INVENTION

Figure 1:
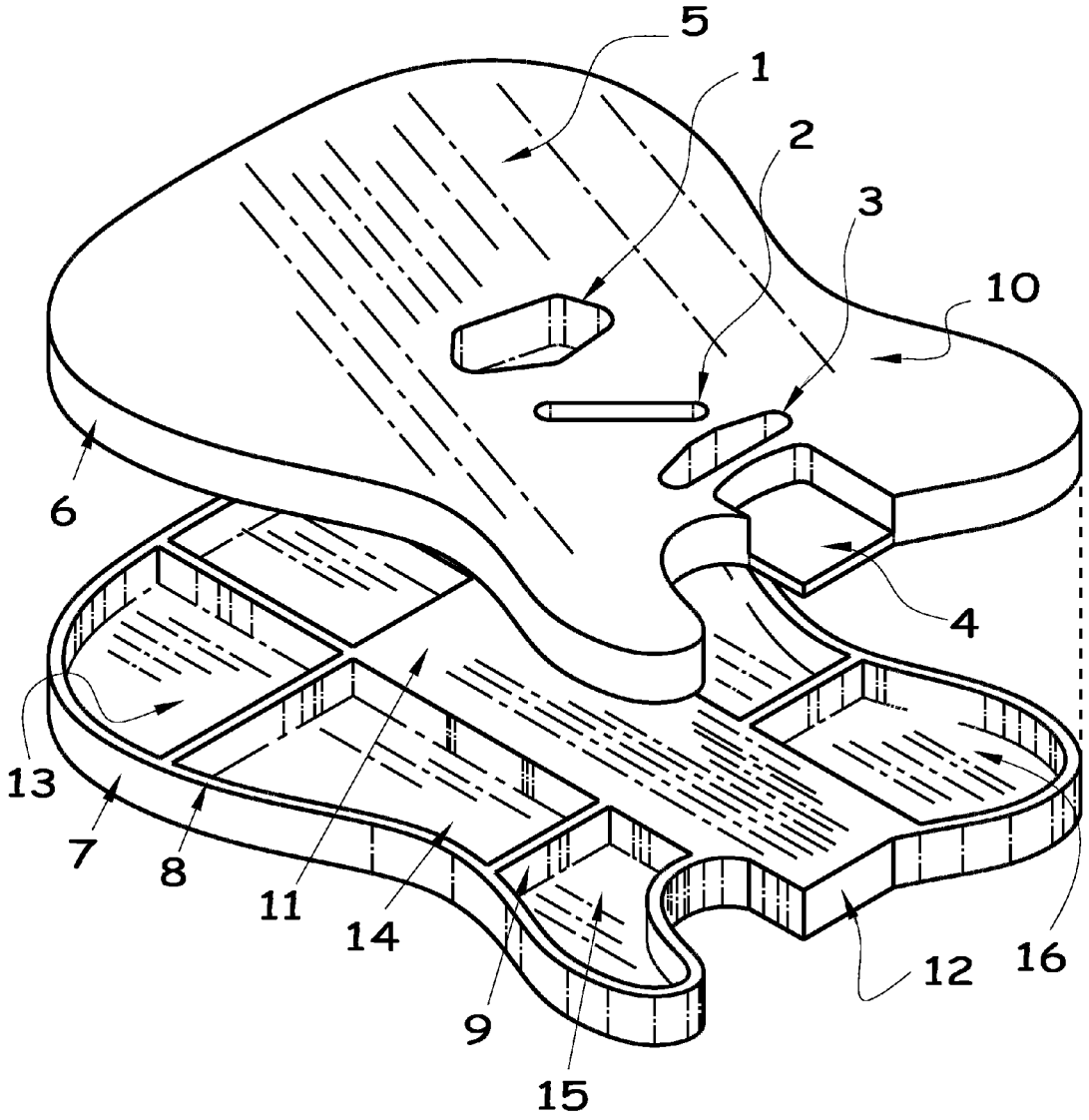
FIG. 1 is an isometric dorso-lateral view of two chambered monolithic body members for a solid body guitar according to the present invention, wherein the top monolithic structure and the bottom monolithic structure that are assembled together in a face to face opposite manner to form the complete guitar body, are shown.

The detailed description set forth below in connection with the appended drawings is intended as a description of the presently preferred embodiment of the invention, and is not intended to limit the invention, its application, or other uses, or represent the only form in which the present invention may be constructed or utilized. The detailed description sets forth the construction and functions of the invention, as well as the sequence of steps for operating the invention in connection with the illustrated embodiment. It is to be understood, however, that the same or equivalent functions may be accomplished by different embodiments that are also intended to be encompassed within the spirit and scope of the invention.

The present invention relates generally to the construction of a stringed musical instrument, and more particularly, but not by way of limitation, to the construction of a guitar composed of a monolithic body having a size and shape similar to that of traditional solid body electric guitars.

The traditional hollow body acoustic guitar is a contrast to a "solid body" electric guitar, wherein the sound is primarily a function of the string vibration. This vibration is sensed by an electromagnetic pickup and then amplified to generate a sound of sufficient volume to be enjoyed by a large listening audience.

Traditional solid body electric guitars, while greatly reducing the so called "feedback effect", achieve sound quality that is distinct from hollow bodied acoustic guitars. The traditional solid body electric guitar contains electromagnetic pickups easily adapted to interpret and amplify the vibrations from the strings of a solid body electric guitar, requiring that the bridge and the electromagnetic pickup are attached to the body of the solid body electric guitar after formation of the solid body. U.S. Pat. No. 4,320,685-A describes a stringed musical instrument comprising a sound box having an instrument top including a sound board, a bridge extending from the sound board, the bridge operatively adapted to space the strings of the musical instrument from the sound board. U.S. Pat. No. 5,895,872 discloses a bridge which is not seamless and does not have a surface smoothly blending into the sound board. Given the disparate materials used for the manufacture of these multiple elements of the guitar body, the current designs of the solid body guitar rely on combining these different elements in a manner that weakens the structure and integrity of the solid body electric guitar, while failing to realize the full potential of the quality of musical tones capable of emanating from the solid body guitar with a unitary construction design.

Thus, there is a continuing need for improvements in the construction of solid body guitars.

It is a general object of the present invention to provide an improved construction for solid body guitars.

More specifically, it is an object of the present invention to provide a method for producing an integrated monolithic aluminum structure for applications in the music industry which may be used to assemble a musical string instrument faster than with prior art due to enablement of being cast for production including the ability of being plated, painted or anodized said aluminum structures achieving better properties such as strength and rigidity while allowing customized design to produce desired tonal qualities and appearance.

The present invention meets one or more of these objects by the method of producing an integrated monolithic aluminum structure, comprising the steps of: (a) providing an aluminum alloy block from an aluminum alloy with a predetermined thickness, (b) shaping or forming the alloy block to obtain a predetermined shaped structure having a built-in radius, (c) heat-treating the shaped structure, (d) optionally machining, e.g. high velocity machining, the shaped structure in order to obtain an integrated monolithic aluminum structure for use as an instrument body member. Further preferred embodiments are described and specified by this specification.

Another objective of the present invention is to provide an electric guitar with a substantially solid body that encloses hollowed out chambers. U.S. Pat. No. 7,507,885 teaches the structure for musical instrument body, and demonstrates how structures are invented to control unwanted resonances, and the extent of variety pertaining to body structures. There are many more examples pertaining to obtain a light yet rigid guitar body.

Still another object of the present invention is to provide a solid body guitar that is lacking a sound hole by which acoustic energy can emanate.

Yet another object of the present invention is to provide a method for constructing the body of a stringed musical instrument wherein the method includes shaping a solid block of material into a body for the musical instrument. Therefore, in view of the foregoing, it can be seen that the metallic composition of the body members give rise to the construction of these components by casting procedures which lend it to efficiency and high production. By employing metal components, not only can these components be plated but accurate cuts can be achieved. The use of metal, particularly light weight metals such as aluminum and magnesium, gives rise to a high strength-to-weight ratio composition permitting increased density of the material over materials such as plastic and wood. The increased density of metal being greater than wood or plastic permits sound waves to travel more faithfully with less resistance through the body, at speeds up to 18 times faster than the speed of sound in air. The high density of metal provides for closer particle compaction whereby particle movement within the metal composition creates different patterns of transverse waves and longitudinal waves through the metal. Traditionally, a transverse wave is one that causes the particles of a medium to vibrate at right angles to the direction in which the wave is moving. A longitudinal wave is one that causes the particles of a medium to vibrate parallel to the direction in which the wave is moving. A sounding body such as the body members 10 and 12 produces longitudinal waves in the air or in some other medium around it. As the body moves back and forth in accordance with the vibrations, the number of condensations and rarefactions produced per second is equal to the frequency of the movement. The chain of alternate condensations and rarefactions constitute the sound waves emitted by the body. Further, depending on the shape of the guitar body surface, these sound waves emitted by the body may also include reflected waves that bounce off of the body.

"Monolithic" is a term known in the art meaning comprising a substantially single unit which may be a single piece formed or created without joint or seams and comprising a substantially uniform whole. The monolithic product obtained by the process of the present invention may be undifferentiated, i.e., formed of a single material, and it may comprise integral structures or features such as a substantially continuous skin having an outer surface or side and an inner surface or side, and integral support members such as ribs or thickened portions comprising frame members on the inside surface of the skin.

In a preferred embodiment of the present invention, the musical instrument body is made of a combination of monolithic top and bottom parts composed of a light metal. Light metals are metals of low atomic weight such as lithium, beryllium, sodium, magnesium and aluminum, although additional elements from the period 4 up to nickel of periodic table may also be included in this category. A preferred embodiment comprises Aluminum 6061 class. A preferred starting material is Aluminum billet which provides a favorable grain structure.

As referred to above, the use of metal permits overall thinness or reduced thickness for the body while providing excellent strength to weight ratio. The external shape can be maintained within a maximum dimension of two inches when combined and within a minimum of ½ inch for the instrument body.

A preferred embodiment has all internal structure thicknesses that are no more than 0.25 inches and no less than 0.025 inches. All dimensions are offset inward from the outer form.

Design also includes at least one or more electronic pickups according to prior art. The integral construction of the slot for receipt of an electro-magnetic or piezoelectric pickup eliminates the need for gluing or fastening a separate bridge support member into the internal structure of the body of the guitar.

The design involves approximately 90% to 96% reduction in weight per unit volume over fully solid metal material designs by removal machining a solid block into an integral structure.

Still another object of the present invention is the provision of novel appearance and feel for a guitar.

These objects are solved by the features of claims 1 and 10.

Other and further objects, features and advantages of the present invention will be readily apparent to those skilled in the art upon a reading of the following disclosure when taken in conjunction with the accompanying drawings.

Turning now to FIGS. 1 to 4, a chambered monolithic body of an electric guitar will be described.

FIG. 1 shows a schematic isometric representation of a guitar body contemplated in the present invention. A guitar body according to the present invention has a monolithic top structure 10 and a monolithic bottom structure 12 that combine in a face-to-face manner aligning outer sides 6 and 7, to enclose chambers 13, 14, 15, 16, 17, 18, and 19. The structures 10 and 12 have outer shapes that are a mirror image of each other to allow precise alignment of the lower edge 8 with its counterpart top edge, creating a smooth outer surface with the outward appearance of a one-piece solid body. The structures 10 and 12 are adjoined by multiple screws distributed throughout the solid body. The plurality of said chambers 13-19 may be designed in different configurations, sizes and shapes than those shown in FIGS. 1-4 and may vary according to structural properties desired.

Chambers 13-19 are contiguous with and flank a central solid monolithic structure 11 that provides a core support structure for the bottom body member 12. This said structure 11 has location and fastener mountings for a tail piece, bridge, and locations and mountings for electro magnetic pickups.

Body top monolithic structure 10 is provided with a pocket 4 for receiving a generic guitar neck. The body top monolithic structure 10 is also provided with slots 1, 2 and 3 for receiving generic bridge and electromagnetic pickups known in the art.

Figure 2:
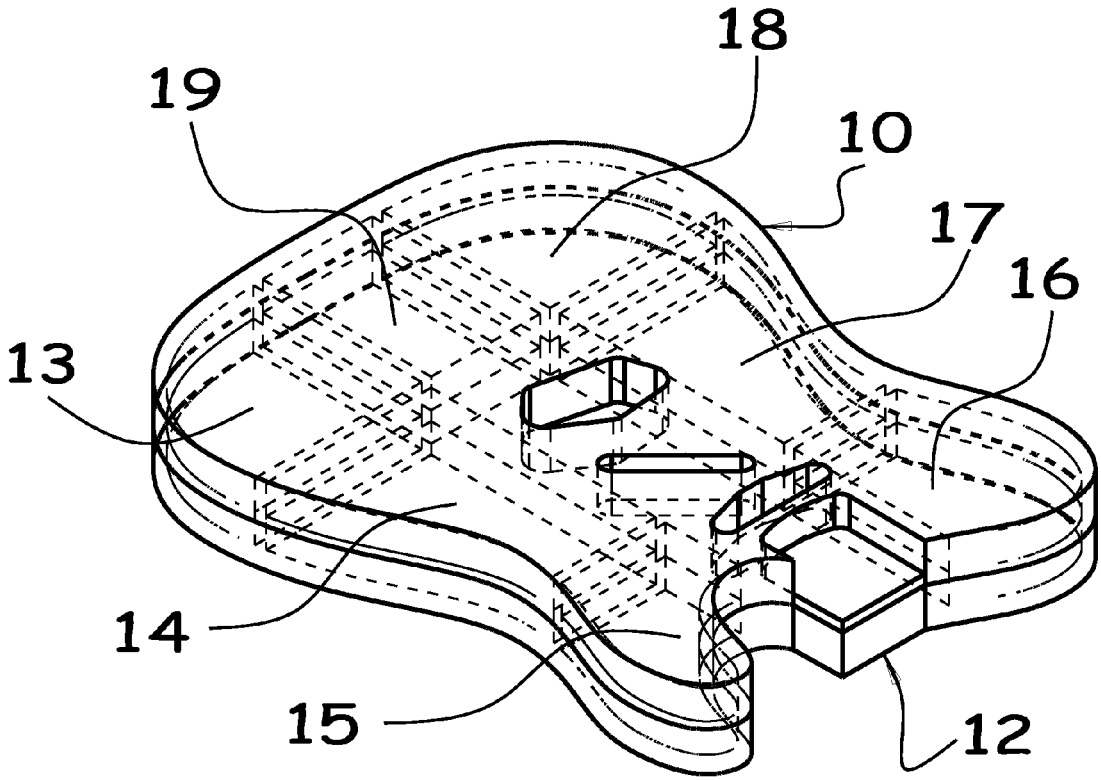
FIG. 2 is a plan view showing the monolithic guitar body and internal chamber array of FIG. 1.
Figure 2:
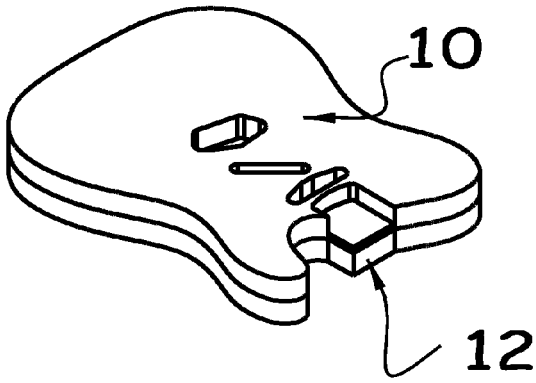

Referring now to FIG. 2 of the drawings, the said guitar body is shown partly in full solid lines and partly in hidden lines with monolithic top part 10 placed directly over the monolithic bottom part 12, creating the solid monolithic guitar body contemplated in one embodiment of the present invention. The top panel in FIG. 2 shows in dotted lines the location and arrangement of the array of said chambers 13-19 internal to the said monolithic guitar body.

Figure 3:
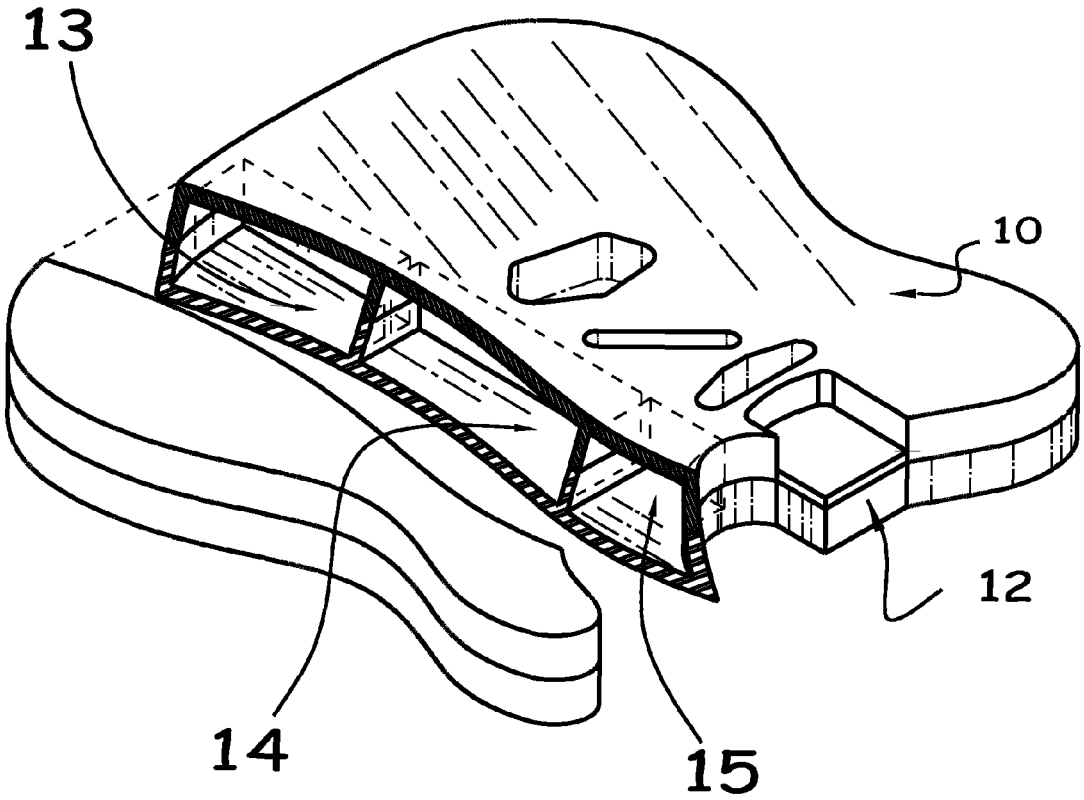
FIG. 3 is an isometric side view longitudinal cutaway of the guitar body of FIG. 1, showing chambers internal to the monolithic guitar body.

Referring now to FIG. 3 of the drawings, an isometric side view longitudinal cutaway of the guitar body of FIG. 1 shows the said chambers 13-15 are closed and contiguous with each other without any connectivity of the internal space between the chambers.

Figure 4:
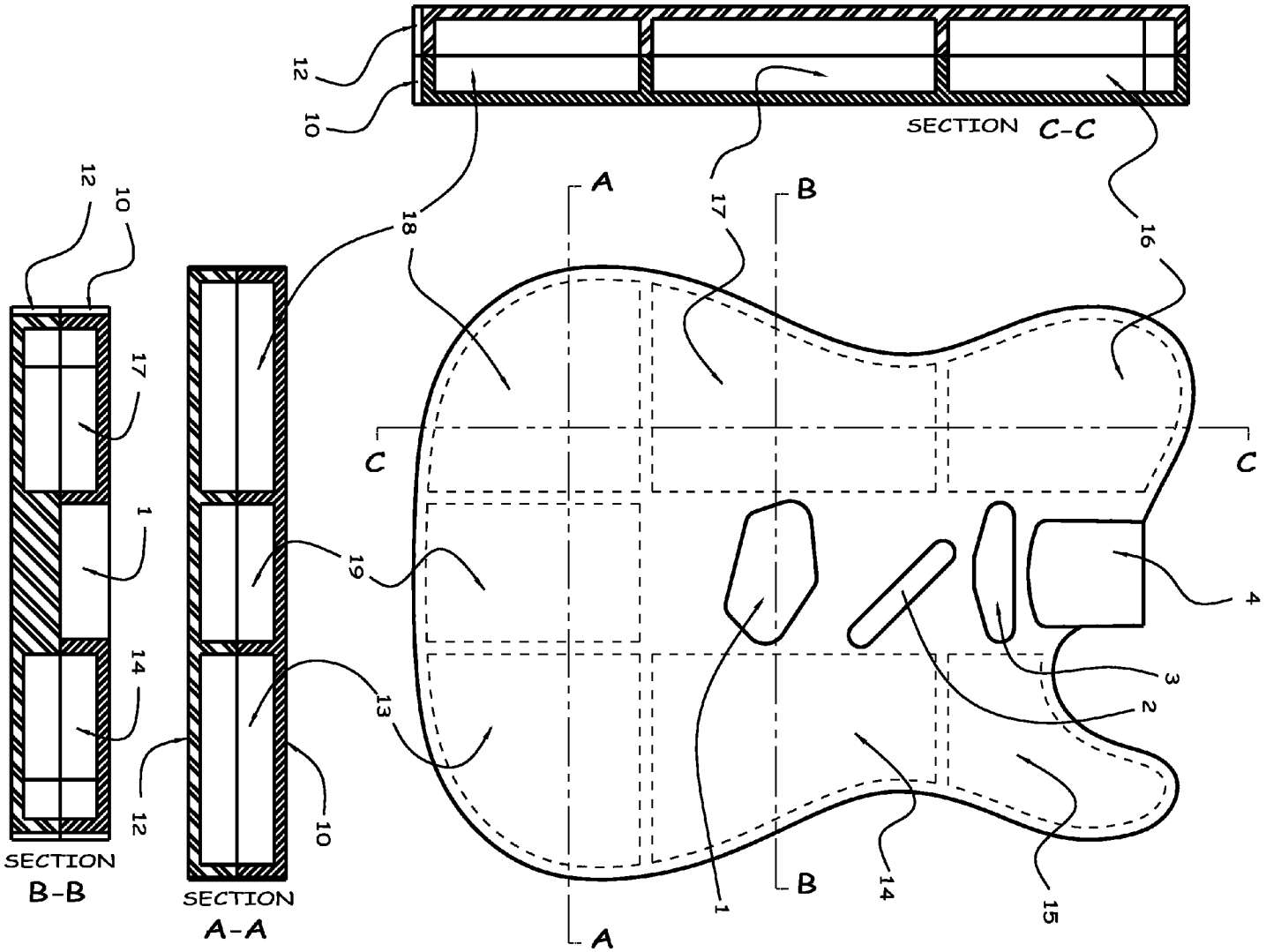
FIG. 4 shows cross-sectional slices of the monolithic guitar body along lines A-A, B-B and C-C.

Referring now to FIG. 4 of the drawings, cross-sectional slices of the said monolithic guitar body of FIG. 1 along lines A-A, B-B and C-C show the relative arrangement of said chambers 13-19 in a preferred embodiment, said chambers being created by the face to face combination of monolithic body top part 10 shown in cross section by narrow shaded lines with monolithic bottom part 12 shown in cross section by widely spaced line doublets, yielding perfectly aligned outer edges 6 and 7 shown in FIG. 1.

As can best be seen by referring to FIGS. 1, 2, 3, and 4 of the drawings, a chamber wall 9 is linking and is integral with the structure center 11 and periphery wall 8 structure as are all sub-parts of a monolithic structure.

The prior described walls 9, ceilings 20, and floors 21, can be dimensionally, geometrically varied to specified characteristics of sound and weight desired.

The present invention is distinct from the chambered electric guitar described by US 2010/0031807 A1 since the present design is not dependent upon the location and/or interconnectivity of the chambers enclosed in the monolithic guitar body for optimal functionality.

The location, number and size of the chambers are completely independent between the top and bottom monolithic halves of the solid body guitar of the present invention. A preferred embodiment of the present invention has an equal number of chambers arranged in a manner that is identical between the top and bottom monolithic halves of the guitar body, to create a symmetrical pattern of chambers, that when assembled provide a mirror image of each other.

In other embodiments of the present invention, the top and bottom monolithic parts of the guitar body may be dissimilar in terms of the number, shape, size and arrangement of the said chambers.

In another embodiment of the present invention, the top and bottom monolithic parts of the guitar body may be dissimilar in terms of overall weight. A preferred embodiment of the present invention has the top monolithic part of the guitar body that is of lighter weight than the bottom monolithic part of the guitar body.

In another embodiment of the present invention, the top and bottom monolithic parts of the guitar body may be dissimilar in terms of material used to create the monolithic parts. A preferred embodiment of the present invention has the top monolithic part made of a light weight metal such as Aluminum or Magnesium, and a bottom monolithic part made of the same or a different light weight metal such as Aluminum or Magnesium.

A method for constructing the body of a stringed musical instrument is also disclosed. The method comprises providing a solid block of material and shaping that solid block of material to form a top or bottom half of the monolithic musical instrument body such as a guitar body. The method further comprises obtaining the desired size and shape specifications for the monolithic body using CAD and CNC machining. The method further comprises achieving a desired strength to weight ratio by machining the monolithic top and bottom parts of the instrument body to remove material from predefined areas of the solid body, creating a desired number of hollowed chambers with desired size, shape and arrangement in the solid body. A preferred method of the present invention achieves the desired said specifications by creating chambers through a process that results in a 90% to 96% reduction in the weight of the said instrument body, without compromising the tensile strength and rigidity of the said instrument body.

This construction results in a guitar of unique appearance, ease of handling and improved function.

In an embodiment the pre-machining thickness of the shaped structure is in the range of three inches (3") to one inch (1"), preferably in the range of 2"-1.5", and more preferably in the range of 1.9"-1.6", and most preferably in the range of 1.8"-1.7". All internal structural thicknesses are no more than 0.375 inches and no less than 0.025 inches. All dimensions are offset inward from the outer form.

The foregoing is considered, as illustrated, to be only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed is:

1. A stringed musical instrument comprising:

a neck, a body fabricated from a rigid material, and a plurality of strings, wherein said body is attached to said neck and said strings are stretched from a point along said neck to a point on said solid body, and wherein said body includes:

a metal monolithic structure body bottom part having a solid non-chambered central structure that is internal and integral to said monolithic body bottom part, and an array of chambers flanking the solid non-chambered central structure; and a metal monolithic structure body top part having an array of respective corresponding chambers, which correspond to the array of chambers of the bottom part, and having one or more slots, wherein the top part and the bottom part are joined at the outside edge and across the entire surface or at multiple contact areas between the body top and bottom parts, to form, from the array of chambers flanking the solid non-chambered central structure and the array of respective corresponding chambers, an array of closed chambers flanking the central structure.

2. The instrument of claim 1, wherein the array of closed chambers flanking the solid non-chambered central structure are formed by areas of removed material from the body at selected non-stress, low resonance points.

3. The instrument of claim 1, wherein said monolithic structure body top part includes at least one ceiling surface, at least one support wall connecting to said central structure, and at least one peripheral wall.

4. The instrument of claim 1, wherein said monolithic structure body bottom part includes a bottom floor, at least one support wall connecting to said central structure, and at least one peripheral wall.

5. The instrument of claim 1, wherein said monolithic structure body top part is structured and arranged to close the chambers within the body and together with said monolithic structure body bottom part forms the body.

6. The instrument of claim 1, wherein said monolithic structure body bottom part is a face-to-face matching, opposing, rigid monolithic structure counterpart of said monolithic structure body top part, and together with said monolithic structure body top part forms the body enclosing the array of closed chambers flanking said central structure, wherein the closed chambers are contiguous closed chambers.

7. The instrument of claim 1, wherein said body further comprises at least one electronic pickup mounted in the vicinity of said strings and used to detect vibrations produced by said strings.

8. The instrument of claim 5, wherein the instrument is a guitar, and wherein the body includes:

an open pocket structured and arranged for receiving the neck; and a bridge and tailpiece structured and arranged for receiving strings from the neck.

9. The instrument of claim 1, wherein said non-chambered central structure is structured and arranged to accommodate one or more pickups of the guitar, which are arranged to correspond with the one or more slots.

10. The instrument of claim 1, wherein top part and the bottom part have an equal number of chambers.

11. The instrument of claim 6, wherein a wall thickness between the contiguous chambers is between 0.025" and 0.375".

12. A method for manufacturing the instrument of claim 1, the method comprising:

shaping a first metal billet to form an outer shape of the metal monolithic structure body bottom part;

shaping a second metal billet to form an outer shape of the metal monolithic structure body top part;

removing material from predefined areas of the first metal billet to form the solid non-chambered central structure that is internal and integral to the monolithic body bottom part and the array of chambers flanking the solid non-chambered central structure to form the metal monolithic structure body bottom part;

removing material from predefined areas of the second metal billet to form the array of respective corresponding chambers, which correspond to the array of chambers of the bottom part, and the one or more slots to form the metal monolithic structure body top part; and joining the top part and the bottom part to form, from the array of chambers flanking the solid non-chambered central structure and the array of respective corresponding chambers, the instrument body having the array of closed chambers flanking the central structure.

* * * * *